US010569126B2

(12) United States Patent
Munroe

(10) Patent No.: US 10,569,126 B2
(45) Date of Patent: Feb. 25, 2020

(54) EXERCISE DEVICE

(71) Applicant: Jack Michael Munroe, Vancouver, WA (US)

(72) Inventor: Jack Michael Munroe, Vancouver, WA (US)

( * ) Notice: Subject to any disclaimer, the term of this patent is extended or adjusted under 35 U.S.C. 154(b) by 37 days.

(21) Appl. No.: 16/018,561

(22) Filed: Jun. 26, 2018

(65) Prior Publication Data

US 2018/0369636 A1 Dec. 27, 2018

Related U.S. Application Data

(60) Provisional application No. 62/525,521, filed on Jun. 27, 2017.

(51) Int. Cl.

| | |
|---|---|
| ***A63B 22/20*** | (2006.01) |
| ***A63B 21/06*** | (2006.01) |
| ***A63B 21/00*** | (2006.01) |

(52) U.S. Cl.

CPC ..... *A63B 22/203* (2013.01); *A63B 21/0617* (2015.10); *A63B 21/4035* (2015.10); *A63B 2210/50* (2013.01)

(58) Field of Classification Search

None

See application file for complete search history.

(56) References Cited

U.S. PATENT DOCUMENTS

| | | | | |
|---|---|---|---|---|
| 6,099,444 | A | 8/2000 | Domenge | |
| 8,353,808 | B1 | 1/2013 | Barney | |
| 8,550,965 | B2 | 10/2013 | Candela et al. | |
| 9,155,930 | B2 * | 10/2015 | Adkins | A63B 21/075 |
| 10,265,563 | B2 * | 4/2019 | Miller | A63B 21/00185 |
| 2003/0032536 | A1 | 2/2003 | Mabe et al. | |
| 2012/0225758 | A1 | 9/2012 | Shaw | |
| 2017/0319900 | A1 * | 11/2017 | Ballo | A61H 1/0237 |

* cited by examiner

*Primary Examiner* — Stephen R Crow

(74) *Attorney, Agent, or Firm* — Global Intellectual Property Agency, LLC; Daniel Boudwin

(57) ABSTRACT

A multi-purpose home workout device. The device comprises a resistive weight with an open channel designed to allow an axle to pass therethrough, such that the axle is operably connected to a wheel, and an outer frame. The outer frame further includes a pair of bracer arms designed to receive the axle and to redistribute the weight of a user across the outer frame. The wheel includes an open interior space and is positioned between the bracer arms such that the resistive weight can rest on the axle within the interior space. Furthermore, the orientation of the wheel and the outer frame allow both to rotate about the axle without interfering with one another's movement. As such the outer frame is predisposed to tilting at non-horizontal angles when in use, and thereby forces a user to train their balance, strength and coordination simultaneously.

14 Claims, 6 Drawing Sheets

EXERCISE DEVICE

CROSS REFERENCE TO RELATED APPLICATION

This application claims the benefit of U.S. Provisional Application No. 62/525,521 filed on Jun. 27, 2017. The above identified patent application is herein incorporated by reference in its entirety to provide continuity of disclosure.

BACKGROUND OF THE INVENTION

The present invention relates to exercise devices. More specifically, the present invention provides a small, easily stored home workout tool that works several different muscle groups and creates very little clutter.

Most commercial gyms provide numerous pieces of specialized equipment, where each piece is specifically designed to work a particular muscle group. To perform a complete workout routine a user would have to transition from one piece of equipment to the next multiple times, making use of multiple pieces of equipment. Home gyms tend to have less space to house multiple pieces of specialized equipment and therefore tend to either be very cluttered or do not provide the tools needed for a user to perform a complete workout routine.

The present invention provides a means for a user to perform a complete workout routine in the privacy and comfort of their own home without adding unwanted clutter in the form of multiple pieces of specialized workout equipment.

Devices have been disclosed in the known art that relate to multi-purpose home workout devices. These include devices that have been patented and published in patent application publications. These devices generally relate to weighted exercise devices that require the user to perform multi-directional rolling movements. However, these devices do not utilize a wheel affixed by an axle to circular handle, wherein the axle includes a resistive weight disposed therein.

In light of the devices disclosed in the known art, it is submitted that the present invention substantially diverges in design elements from the known art and consequently it is clear that there is a need in the art for an improvement to existing multi-purpose home workout devices. In this regard the instant invention substantially fulfills these needs.

SUMMARY OF THE INVENTION

In view of the foregoing disadvantages inherent in the known types of multi-purpose home workout now present in the known art, the present invention provides a new multi-purpose home workout device wherein the same can be utilized for providing convenience for the user when performing a complete exercise routine in a home gym.

It is therefore an object of the present invention to provide a new and improved exercise device that has all of the advantages of the known art and none of the disadvantages.

It is another object of the present invention to provide a wheel having an outer layer, a first side, a second side, and an open interior volume disposed therebetween, such that a resistive weight is housed therein.

Another object of the present invention is to provide a wheel including an axle disposed between a pair of bracer arms operably connected to an outer frame, such that the orientation of the wheel is perpendicular to the orientation of the outer frame and the bracer arms are designed to receive the axle and to redistribute the weight of a user across the outer frame.

An additional object of the present invention is to provide a resistive weight including a channel sized and proportioned for an axle to pass through, such that the axle can support the weight once inserted therethrough;

A further object of the present invention is to provide a resistive weight in the form of a cylindrical block having an upper portion and a lower portion, such that the channel for the axle is disposed in the upper portion.

Yet another object of the present invention is to provide a first wheel cap having a first center bore configured to receive an axle therethrough, wherein the first wheel cap is disposed on the first side of a wheel, such that the first center bore is connected to the outer layer of the wheel, and to similarly provide a second center bore configured to receive an axle therethrough disposed on the second side of a wheel and connected to the outer layer of the wheel by a second wheel cap.

Yet still another object of the present invention is to provide a wheel designed to rotate about the axle in a controlled back and forth motion that alternatingly pushes the resistive weight outward and then pulls the resistive weight back inward, and an outer frame is designed to provide a plurality of hand holds for the user and to drive the back and forth motion of the wheel.

Another object of the present invention is to provide a multi-purpose home workout device that may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figures 1A, 1B:
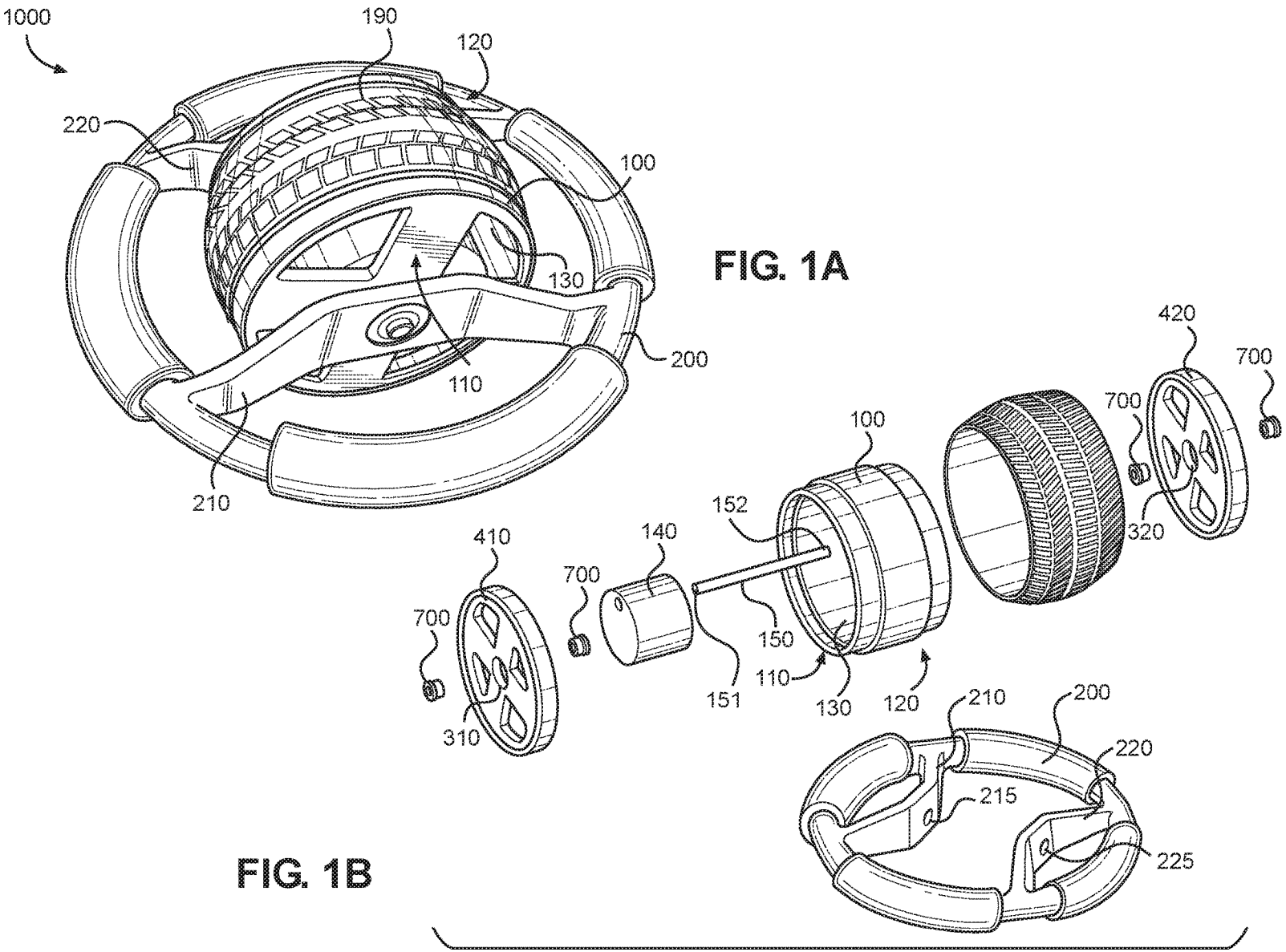
FIG. 1A shows a perspective view of an embodiment of an exercise device.
FIG. 1B shows an exploded view of an embodiment of an exercise device.

Reference is made herein to the attached drawings. Like reference numerals are used throughout the drawings to depictor similar elements of the multi-purpose home workout device. For the purposes of presenting a brief and clear description of the present invention, the preferred embodiment will be discussed as used for a multi-purpose home workout device. The figures are intended for representative purposes only and should not be considered to be limiting in any respect.

Referring now to FIGS. 1A and 1B, there are shown a perspective view, and an exploded view respectively of an embodiment of an exercise device, respectively. The exercise device 1000 comprises a wheel 100 having a treaded outer layer 190, a first side 110, and a second side 120. An open interior volume 130 is provided between the two sides 110, 120 such that a resistive weight 140 can be housed therein. In the illustrated embodiment, the wheel 100 further includes an axle 150 disposed between a first bracer arm 210 and a second bracer arm 220, such that both arms 210, 220 are operably connected to a circular outer frame 200. The first bracer arm 210 includes a first aperture 215 configured to facilitate passage therethrough of the axle 150. Similarly, the second bracer arm 220 includes a second aperture 225 configured to facilitate passage therethrough of the axle 150. The orientation of the wheel 100 is perpendicular to the orientation of the circular outer frame 200, such that no movement of the circular outer frame 200 can interfere with the rotation of the wheel 100 about its axle 150. Furthermore, in use the wheel 100 is configured to rotate about the axle 150 in a controlled back and forth motion that alternating pushes the resistive weight 140 outward and then pulls the resistive weight 140 back inward.

In the illustrated embodiment a first center bore 310 disposed at the center of a first wheel cap 410 is configured to receive the first end 151 of the axle 150 therethrough. The first wheel cap 410 operably connects the first center bore 310 to the wheel 100. Similarly, a second center bore 320 disposed at the center of a second wheel cap 420 is configured to receive the second end 152 of the axle 150 therethrough, and the second wheel cap 420 operably connect the second center bore 320 to the wheel 100.

Figure 2C:
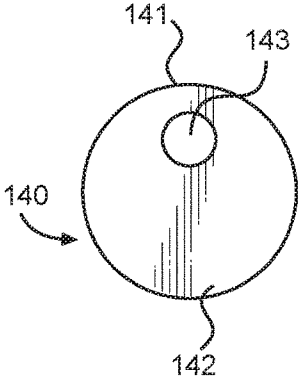
FIG. 2C shows a front view of a resistive weight of an embodiment of an exercise device.
Figure 2B:
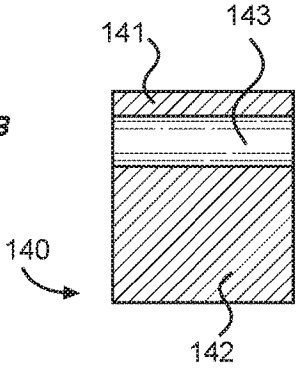
FIG. 2B shows a cross-sectional view along line 2B of a resistive weight of an embodiment of an exercise device.
Figure 2A:
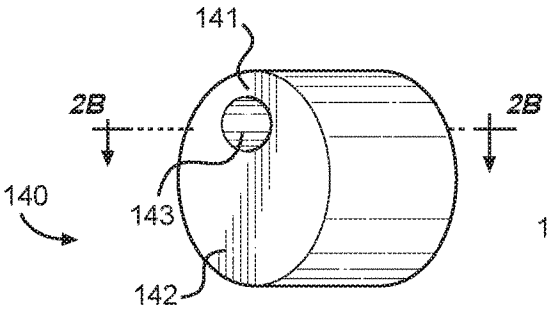
FIG. 2A shows a perspective view of a resistive weight of an embodiment of an exercise device.

Referring now to FIGS. 2A, 2B, and 2C, there are shown a perspective view, a cross-sectional view along line 2B, and a front view of a resistive weight of an embodiment of an exercise device, respectively. In the illustrated embodiment the resistive weight 140 is a cylindrical block having an upper portion 141 and a lower portion 142, such that a channel 143 sized and proportioned to receive the axle 150 is disposed in the upper portion 141. By positioning the channel 143 offset from a center and in the upper portion 141 of the weight 140, a person using the exercise device 1000 will have to bear a greater portion of the inertial force of the weight 140 while rolling the device back and forth thereby creating a more intense workout experience for the user.

In other embodiments the position of the channel 143 is directly in the center of the weight 140 for ease of manufacturing. Alternatively, in other embodiments the axle is configured to carry the weight 140 with it through each rotation of the wheel 100. Such a configuration provides yet another means of forcing the person using the exercise device 1000 to work harder when rolling the wheel 100 back and forth.

Figure 3A:
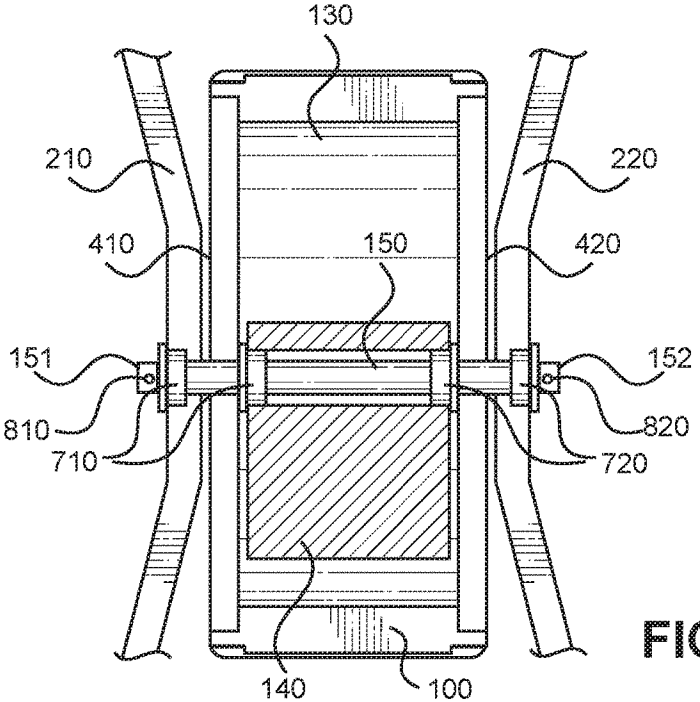
FIG. 3A shows a close-up view of the inner workings of the wheel and axle portion of an embodiment of an exercise device.
Figure 3B:
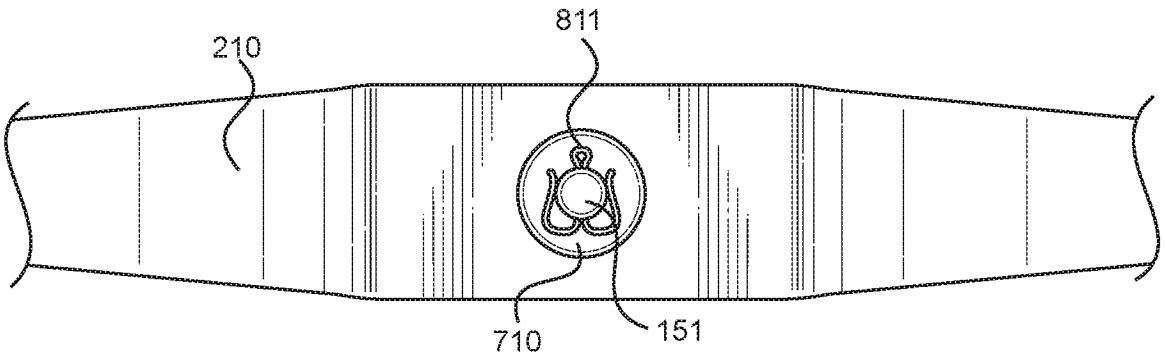
FIG. 3B shows a side view of the first bracer arm of an embodiment of an exercise device.
Figure 3C:
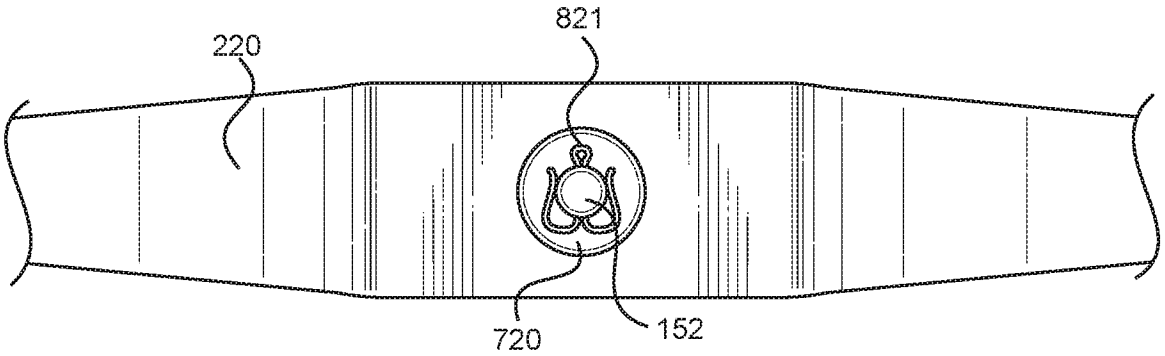
FIG. 3C shows a side view of the second bracer arm of an embodiment of an exercise device.

Referring now to FIGS. 3A, 3B and 3C, there is shown a close-up view of the inner workings of the wheel and axle portion, a side view the first bracer arm of an embodiment of an exercise device, and a side view of the second bracer arm of an embodiment of an exercise device, respectively. In the illustrate embodiment, the axle 150 is used to interconnect the wheel 100 and the resistive weight 140 contained therein to the bracer arms 210, 220 and the outer frame.

A first plurality of oil impregnated flanged bushings 710 are inserted along the axle 150 between the resistive weight 140 and the first wheel cap 410, as well as outside of the first bracer arm 210. Similarly, a second plurality of oil impregnated flanged bushings 720 are inserted along the axle 150 between the resistive weight 140 and the second wheel cap 420, as well as outside of the second bracer arm 220. The oil impregnated flanged bushings 710, 720 provide a prelubricated buffer for the axle 150, the resistive weight 140, the center bores 310, 320, and the bracer arms 210, 220 to reduce wear and tear caused by excessive friction as parts move past one another during each rotation of the wheel 100. In other embodiments ball bearings are used instead of the oil impregnated flanged bushings 710, 720 to reduce manufacturing cost and to simplify the manufacturing process for the exercise device 1000.

Furthermore, the axle 150 is sized and proportioned to be inserted through the first plurality of oil impregnated flanged bushings 710, the first bracer arm 210, the first wheel cap 410, the resistive weight 140, the second wheel cap 420, the second bracer arm 220, and the second plurality of oil impregnated flanged bushings 720, such that the first end 151 of the axle 150 is secured by a first fastener 811 to the first bracer arm 210 and the second end 152 of the axle 150 is secured by a second fastener 821 to the second bracer arm 220. The first fastener is configured to be inserted through a third aperture 810 disposed on the outer surface of the axle 150 toward the first end 151. The second fastener 821 is similarly configured to be inserted through a third aperture 820 disposed on the outer surface of the axle 150 toward the second end 152. By ensuring that the wheel 100, the axle 150, and the resistive weight 140 are all operably connected to the bracer arms 210, 220 the outer frame 200 can be used to drive the exercise device 1000 when working out.

In the illustrated embodiment, the first bracer arm 210 of the circular outer frame 200 includes a bore configured to allow the axle to pass therethrough, and the first fastener 811 is used to secure the first end 151 of the axle to the first bracer arm 210. The second bracer arm 220 (not shown) is identically configured, to allow the axle to pass therethrough, and the second fastener 821 to secure the second end 152 of the axle 150 to the second bracer arm 220. In one embodiment, the axle 150 is shown to protrude beyond the bracer arms 210, 220 on either side of the wheel. Accordingly, the fasteners used here are cotter pins inserted through the apertures 810,820 such that the device can be more easily disassembled, and to keep the manufacturing costs low. In other embodiments, bolts or other heavy-duty fasteners can be used to create a more secure connection while retaining the ability to disassemble the device.

Figure 4:
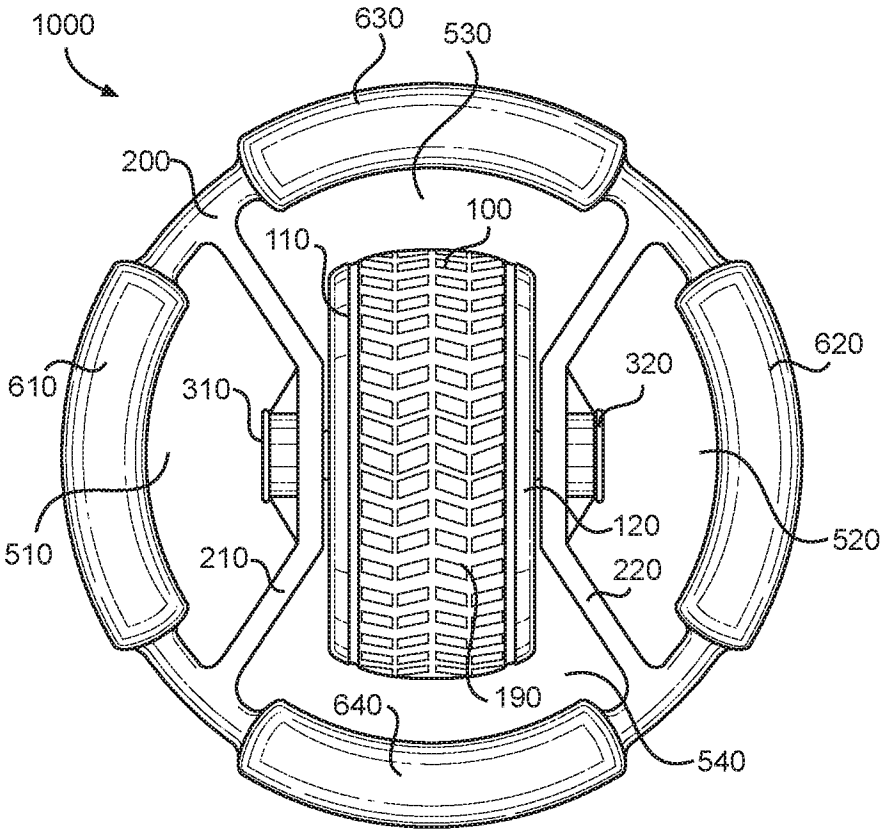
FIG. 4 shows a top plan view of an embodiment of an exercise device.

Referring now to FIG. 4, there is shown a top plan view of an embodiment of an exercise device. In the illustrated embodiment the bracer arms 210, 220 of the circular outer frame 200 are also configured to redistribute the weight of a user across the outer frame 200. Additionally, the first bracer arm 210 extends laterally across the circular frame 200 to create a first segment 510, and the second bracer arm 220 extends laterally across the circular frame 200 to create a second segment 520. The portion in between the bracer arms 210, 220 is further sub-divided by the wheel 100 to create a third segment 530 and a fourth segment 540.

Furthermore, the segments 510, 520, 530, and 540 form convenient positions for hand holds around the body of the frame 200. In one embodiment, a portion of the frame 200 enclosed within each segment 510, 520, 530, and 540 is covered by a soft cushion like material to create a handle, such that the portion of the frame 200 in the first segment 510 is converted into a first handle 610, the portion of the frame 200 in the second segment 520 is converted into a second handle 620, the portion of the frame 200 in the third segment 530 is converted into third handle 630, and the portion of the of the frame 200 in fourth segment 540 is converted into a fourth handle 640. In one exemplary use, a person working out can grab any two opposing handles either, 610 and 620 or 630 and 640, with their hands and while balancing their weight across the circular frame 200 lower themselves down and raise themselves up to perform some enhanced push-ups. More specifically, when handles 610 and 620 are used the ability of the wheel 100 to fully rotate about the axle also facilitates angling of the frame about the axle such that while balancing their weight to perform enhanced push-ups a person working out could also tilt the circular frame at a non-horizontal angle about the axle to increase the intensity of the exercise being performed.

Figure 5A:
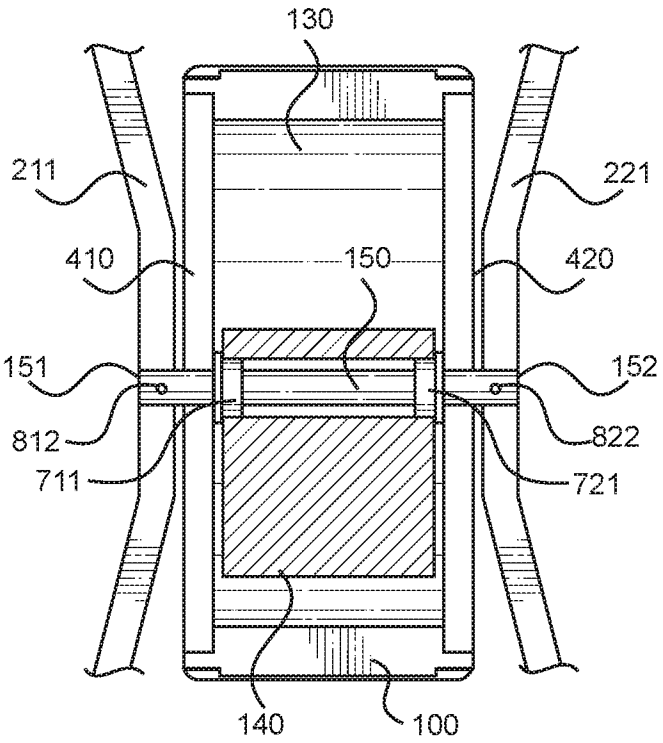
FIG. 5A shows a close-up view of the inner workings of the wheel and axle portion of an alternate embodiment of an exercise device.
Figure 5B:
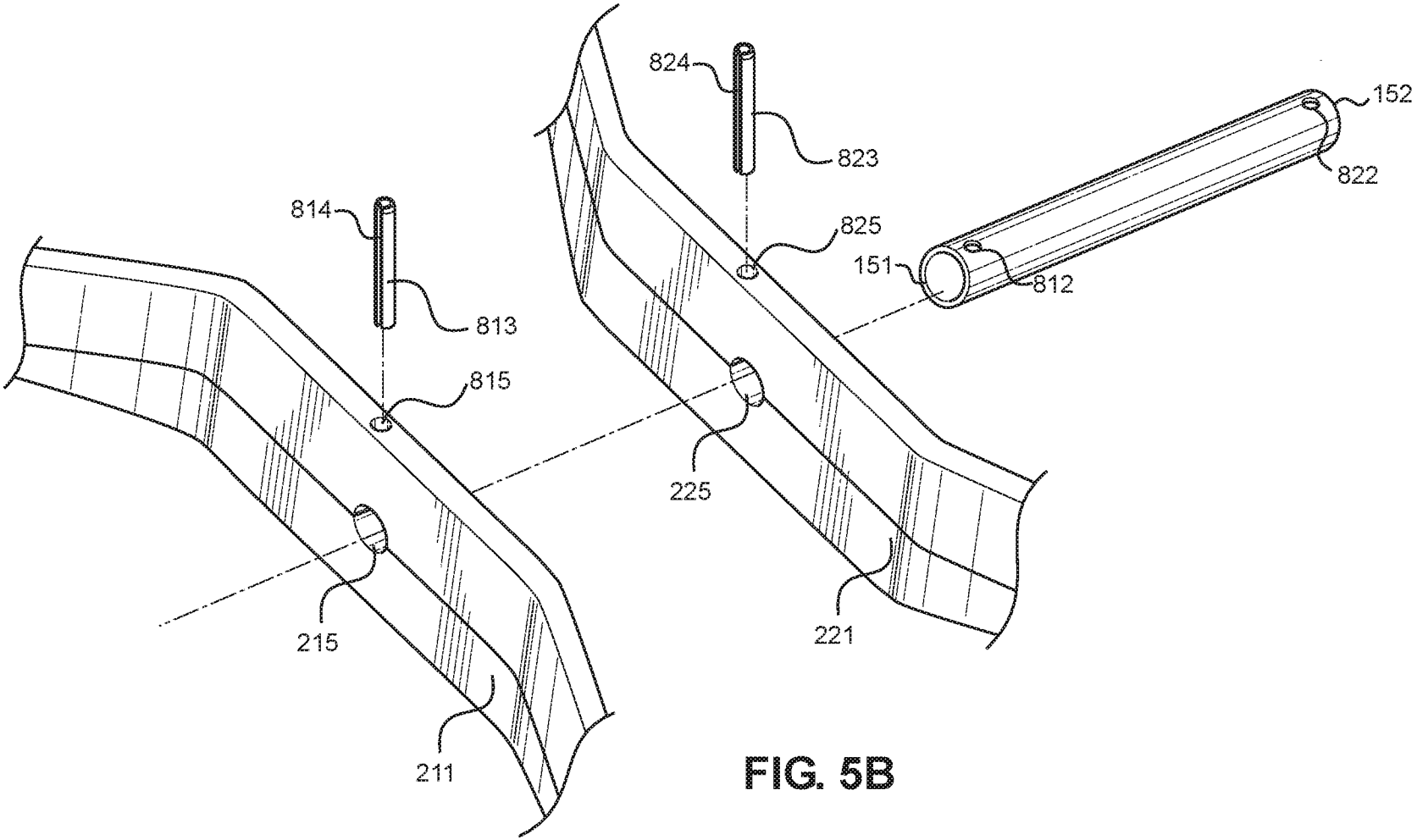
FIG. 5B shows a perspective view of an axle of an embodiment of an exercise device.

Referring now to FIGS. 5A and 5B, there are shown a close-up view of the inner workings of the wheel and axle portion of an alternate embodiment of an exercise device, and a perspective view of an axle of an alternate embodiment of an exercise device, respectively. In the illustrated embodiment, the axle 150 is used to interconnect the wheel 100 and the resistive weight 140 contained therein to the bracer arms 211, 221 of the the outer frame. Unlike the embodiment shown in FIG. 3A, in this embodiment the ends 151, 152 of the axle 150 do not protrude on either side of the wheel 100. Instead the bracer arms are sued and proportioned to be thick enough for the ends 151, 152 to be flush with the outer surface of the bracer arms 211, 221. Additionally, the first bracer arm 211 includes a fifth aperture 815 such that a first spring pin 813 can be inserted through both the bracer arm 211 and a first hole 812 along the outer surface of the axle 150. Similarly, the second bracer arm 221 also includes a sixth aperture 825 such that a second spring pin 823 can be inserted through both the bracer arm 221 and a second hole 822 along the outer surface of the axle 150. The spring pins 813, 823 are identically configured to include a slit 814, 824 along the length of spring pin 813, 823 such that when pressed together the spring pins 813, 823 can pass through the apertures 815,825 on bracer arms 211, 221 and the holes 812, 822 disposed along the axle.

After being inserted, and the compression is released the spring pins 813, 823 are configured to expand and to more tightly secure the axle 150 to the bracer arms 211, 221. In this alternate embodiment the axle 150 is locked in place with the bracer arms 211, 221, via the apertures 815, 825. As a result, the axle 150 is not free to rotate independent of the wheel 100 as was the case in the first embodiment and therefore less frictional heat is generated during rotation of the wheel 100. Correspondingly, there is less need for the lubrication provided by the oil impregnated flanged bushings. Instead a single pair of bearings 711, 721 can be used to facilitate rotation of the wheel 100 about the axle 150. Furthermore, the spring pins 813, 823 are not configured to be removably inserted into the axle apertures 812, 822. Once installed the axle 150 and the bracer arms 211, 221 are permanently attached and the exercise device cannot be disassembled. Removing the option of disassembly of the exercise device reduces the incidence of users tampering with the device configuration and protects the device from accidental damage that the user may cause.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

I claim:

1. An exercise device, comprising:

a wheel having a first side, a second side, and an open interior volume disposed therebetween, such that a resistive weight is housed therein;

the wheel further including an axle disposed between a first bracer arm and a second bracer arm, operably connected to an outer frame, such that an orientation of the wheel is perpendicular to an orientation of the outer frame, wherein the bracer arms are configured to receive the axle;

the resistive weight further including an open channel sized and proportioned for the axle to pass through;

a first center bore configured to receive the axle therethrough is disposed on a first wheel cap on the first side of the wheel such that the first bore is operably connected to the wheel by the first wheel cap, and a second center bore configured to receive the axle therethrough is disposed on a second wheel cap on the second side of the wheel such that the second bore is operably connected to the wheel by the second wheel cap;

wherein the wheel is configured to rotate about the axle in a controlled back and forth motion that alternatingly pushes the resistive weight outward and then pulls the resistive weight back inward, and the outer frame is configured to provide a plurality of hand holds for a user.

2. The exercise device according to claim 1, wherein the axle having a first end and a second end, is configured to be inserted through a first aperture in the first bracer arm, the first center bore of the first wheel cap, the resistive weight, the second center bore of the second wheel cap, and a second aperture in the second bracer arm, such that the first end of the axle is secured to the outer frame by a first fastener to the first bracer arm and the second end of the axle is secured to the outer frame by a second fastener to the second bracer arm.

3. The exercise device according to claim 2, wherein the first end of the axle protrudes beyond the first bracer arm and the second end of the axle protrudes beyond the second bracer arm, such that the first and second fasteners can be removably secured to the outer frame and allow for the device to be disassembled.

4. The exercise device according to claim 2, wherein the first end of the axle is flush with the first bracer arm and the second end of the axle is flush with the second bracer arm, such that the first and second fasteners are permanently secured to the outer frame and do not allow for the device to be disassembled.

5. The exercise device according to claim 1, wherein the resistive weight is cylindrical block having an upper portion and a lower portion, such that the channel for the axle is disposed in the upper portion.

6. The exercise device according to claim 1, wherein the outer frame is circular.

7. The exercise device according to claim 6 wherein the first bracer arm extends laterally across the circular frame to create a first segment, the second bracer arm extends laterally across the circular frame to create a second segment, and the wheel further sub-divides the remaining portion in between into a third segment and a fourth segment.

8. The exercise device according to claim 7, wherein a portion of the first segment is covered by a soft cushion like material to form a first handle, a portion of the second segment is covered by a soft cushion like material to form a second handle, a portion of the third segment is covered by a soft cushion like material to form a third handle, and a portion of the fourth segment is covered by a soft cushion like material to form a fourth handle.

9. The exercise device according to claim 8, wherein the outer frame is further configured to freely tilt about the axle at non-horizontal angles.

10. The exercise device according to claim 9, wherein any two opposing handles of the outer frame are configured to facilitate the user balancing their weight across the frame.

11. The exercise device according to claim 1, wherein the outer frame is further configured to drive the back and forth motion of the exercise device when working out.

12. The exercise device according to claim 7, wherein the bracer arms indent at the center, such that the portion of the circle in between the first and second segments is broader at the ends and narrower in center.

13. The exercise device according to claim 1, wherein a plurality of oil impregnated flanged bushings are inserted between the axle and the bracer arms on both sides of the wheel.

14. The exercise device according claim 1, wherein an outer layer of the wheel is treaded.

* * * * *